United States Patent [19]

Miller

[11] Patent Number: 4,745,945

[45] Date of Patent: May 24, 1988

[54] THERMAL EXPANSION RELIEF ARRANGEMENT FOR CLOSED PLUMBING SYSTEM

[75] Inventor: Louis M. Miller, Dracut, Mass.

[73] Assignee: Watts Regulator Company, Dracut, Mass.

[21] Appl. No.: 910,532

[22] Filed: Sep. 23, 1986

[51] Int. Cl.[4] ..... F16K 49/00

[52] U.S. Cl. ..... 137/334; 137/434; 137/444; 137/881; 137/883

[58] Field of Search ..... 137/564, 563, 434, 881, 137/883, 540, 442, 443, 444, 334

[56] References Cited

U.S. PATENT DOCUMENTS

| | | | |
|---|---|---|---|
| 2,635,622 | 4/1953 | Owens | 137/218 |
| 2,908,228 | 10/1959 | Carr et al. | 137/540 |
| 3,111,942 | 11/1963 | Miller | 137/563 |
| 3,319,913 | 5/1967 | Schoepe et al. | 248/75 |
| 3,428,966 | 2/1969 | Schoepe et al. | 4/56 |
| 3,429,333 | 2/1969 | Schoepe et al. | 137/315 |
| 3,495,803 | 2/1970 | Schoepe et al. | 251/25 |
| 3,576,199 | 4/1971 | Schoepe et al. | 137/414 |
| 3,624,893 | 12/1971 | Schoepe et al. | 29/429 |
| 3,626,574 | 12/1971 | Schoepe et al. | 29/796 |
| 3,789,865 | 2/1974 | Borman | 137/563 |

OTHER PUBLICATIONS

Watts Regulator, Catalog C-85 a, Watts Regulator Co., Lawrence, Mass.

A.S.S.E., Performance Requirements for Water Closet Flush Tank Ball Corks.

*Watts My Line*, "Subject: Excessive Water Pressured Caused by Thermal Expansion", (Mar., 1980).

*Watts My Line*, "Subjet: Thermal Expansion Control" (Jan., 1984).

*Watts My Line*, "Subject: Thermal Expansion Control" pansion Relief Valve" (Jan., 1985).

Correspondence and Attachments; Richard Clary Spotswood Parlar and Company to Mr. George L. Craft, (Jan. 20, 1982).

Correspondence, Georgia Department of Community Affairs and related attachments. (Jan., 1985, (undated).

*Primary Examiner*—A. Michael Chambers

[57] ABSTRACT

A fill valve assembly installed in a toilet flush tank includes a pressure relief valve adapted to activate at a predetermined pressure to discharge water from a system of piping to relieve pressure due to thermal expansion of water in the piping system.

8 Claims, 2 Drawing Sheets

THERMAL EXPANSION RELIEF ARRANGEMENT FOR CLOSED PLUMBING SYSTEM

Figure 1:
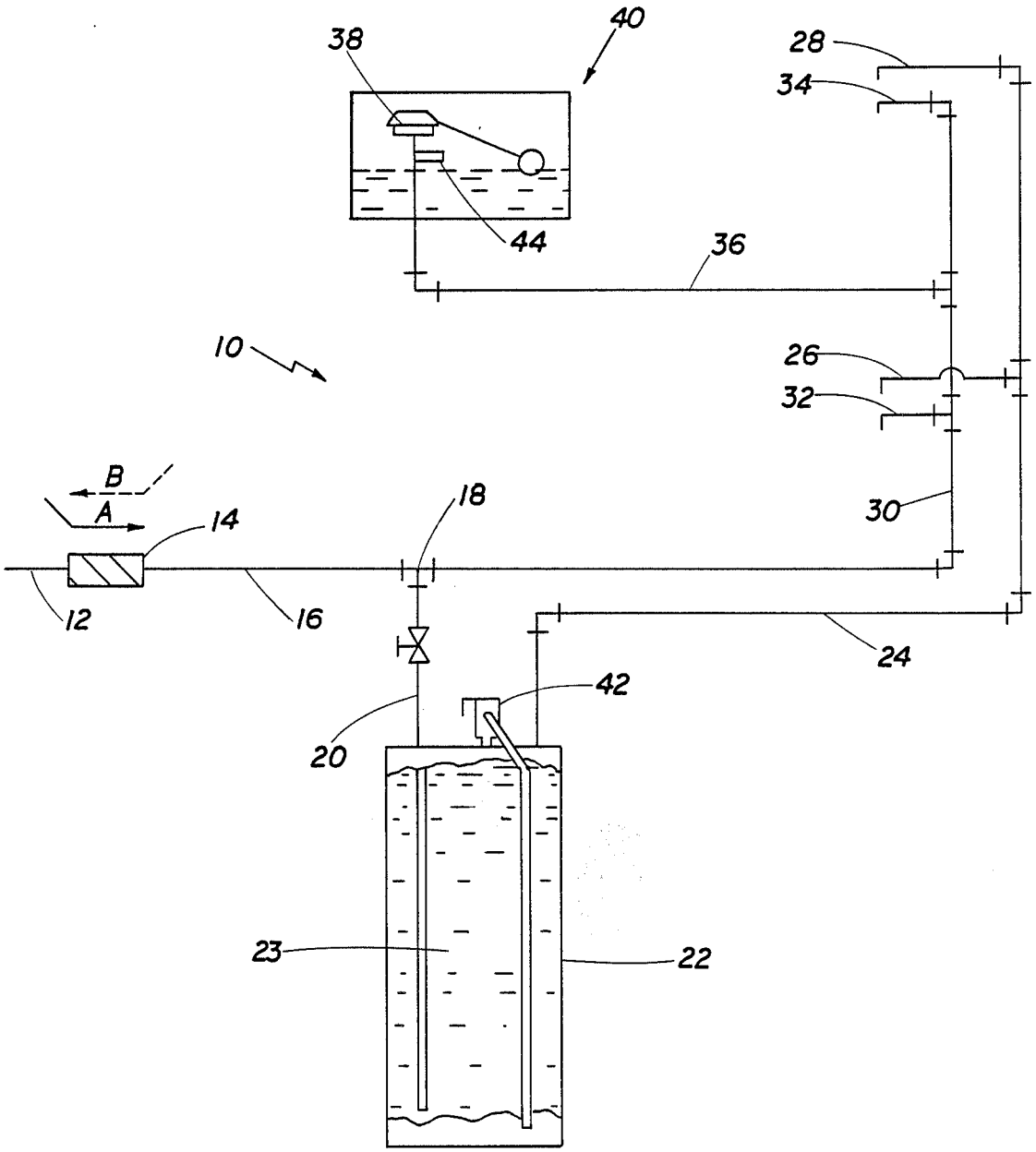

The invention relates to closed plumbing systems, e.g., in the home, which are subject to damage due to thermal expansion caused, e.g., by temperature rise of cold makeup water or by operation of the hot water heater to increase water temperature for domestic use.

In a typical application, as hot water is withdrawn from a closed system, colder makeup water enters. As the makeup water is heated, it expands, increasing pressure in the system. Unless system components are provided for release of the excess pressure at some low predetermined level, damage to expensive components of the system is a possibility.

In prior systems, pressure relief has been provided by a temperature-and-pressure relief valve on the hot water heater, set at a predetermined level below the pressure at which the heater itself would be damaged, e.g., 150 pounds per square inch is typical. Relief valves on water heaters are subject to premature failure due to liming and buildup of solids and excessive wear from repeated cycles of thermal expansion. Relief in closed systems typically requires the installation of a secondary relief valve somewhere in the cold water line, the secondary valve being set to relieve at some pressure lower than the temperature-and-pressure relief valve setting on the water heater, thus avoiding the lime deposit and excessive wear problems.

Combination temperature-and-pressure relief valves and pressure-only valves installed in cold water lines have the disadvantage of requiring a drain for receiving the water discharged upon relief. The alternative is the use of expansion tanks which have the advantage of not requiring overflow drains, but the disadvantage of the added expense, making this solution less desirable, particularly in domestic systems.

In the past, many systems have avoided pressure build-up by allowing the water being heated to expand back into the main water supply line. However, the general trend now is to conserve water and protect the potable water supply by using water pressure reducing valves and backflow preventers, both of which create closed systems in the home by preventing water from expanding back into the mains. In order to protect the water supply, plumbing codes now require backflow preventers in the service supply pipes to avoid catastrophic contamination of the primary supply system from backflow of private secondary systems.

The objectives of this invention include providing a reliable thermal expansion pressure relief arrangement; providing a relief arrangement that does not require any piping or drains; providing a relief arrangement for use in the cold water line where it is less susceptible to liming; and providing a thermal expansion pressure relief arrangement that can be simply and quickly installed for reliable protection of the entire plumbing system.

SUMMARY OF THE INVENTION

According to the invention, in a water piping arrangement connected to a main water supply conduit, the arrangement comprising a system of pipes adapted to conduct water, and, disposed in the system of water-conducting pipes, a backflow preventer valve adapted to permit flow of water from the main water supply conduit into the arrangement and to prevent flow of water in the reverse direction, a water heater, a primary relief valve disposed in a hot water line associated with the heater or on the heater and adapted to activate at a predetermined activation pressure selected to be below the pressure at which the arrangement would be damaged to relieve pressure in the system, and a toilet flush tank, including a fill valve assembly, there is an improvement wherein the fill valve assembly further comprises a pressure relief valve adapted to activate at a predetermined pressure below the activation pressure of the primary relief valve to release water from the system of pipes into the toilet flush tank to maintain water pressure in the system below a predetermined maximum.

In preferred embodiments, the secondary relief valve is constructed in a manner to cause water released from the system to flow directly into an overflow tube in the toilet flush tank; and the secondary relief valve and the fill valve assembly are integrally joined.

According to another aspect of the invention, a method of providing secondary relief from buildup of water pressure in a system of piping due to thermal expansion of water in the system comprises installing, in a toilet flush tank, a secondary pressure relief valve adapted at a predetermined pressure below a pressure of activation of a primary relief valve, to activate to release water from the system into the toilet flush tank, thereby maintaining the pressure in the system below a predetermined maximum.

In a preferred embodiment of the method, the secondary pressure relief valve is integrally formed with a fill valve assembly and the method comprises installing the secondary pressure relief valve and fill valve assembly as a unit.

According to still another aspect of the invention, in a fill valve assembly adapted for use in a toilet flush tank, the assembly comprising a body defining a chamber for water from a water inlet pipe, a fill valve in communication with the water inlet pipe, and a float means for actuating the fill valve for flow of water from the inlet pipe therethrough, there is an improvement wherein the fill valve assembly further comprises a pressure relief valve disposed in communication, through the body, with the water inlet pipe, the pressure relief valve comprising a body and pressure relief means adapted to activate at a predetermined pressure to allow flow of water therethrough.

In preferred embodiments of this aspect of the invention, the body of the fill valve assembly and the body of the relief valve are integrally formed, e.g. by molding.

These and other objectives and features of the invention will be understood from the following description of a preferred embodiment and from the claims.

PREFERRED EMBODIMENT

We first briefly describe the drawings.

Drawings

Figure 2:
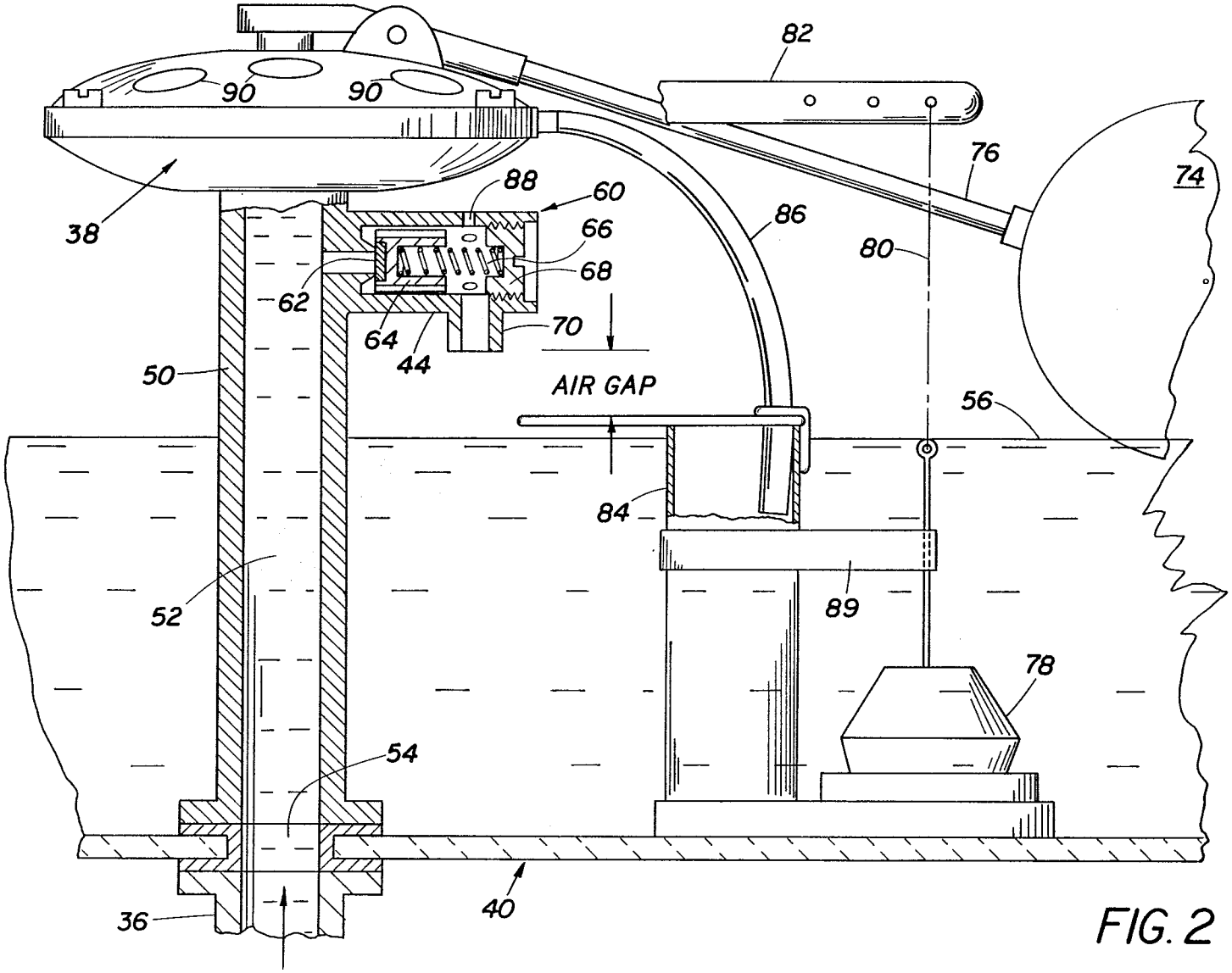

FIG. 1 is a somewhat diagrammatic view of an example of a closed (relatively simple) plumbing system employing a thermal expansion pressure relief arrangement according to the invention; and FIG. 2 is a side view partially in a section of a water closet containing a standard fill valve assembly equipped with thermal expansion pressure relief arrangement according to the invention.

In FIG. 1, a simplified plumbing system 10, e.g., as found in the home, is shown somewhat diagrammatically. Water is supplied into the system via main line connection 12, through a check valve, regulator or backflow preventer 14. Valve 14 is constructed to permit flow only in the direction of arrow, A, and creates a closed system on the downstream or house side 16. Backflow from the house, indicated by dashed arrow, B, is not permitted, in order to prevent contamination of the main supply by water flowing to the main from the domestic system.

At T-connection 18, cold water from the main supply line is diverted in pipe 20 into the water heater 22. Water in heater 23 is heated to a predetermined temperature, controlled by a thermostat (not shown). Hot water from within the heater then flows on demand via pipe 24 to, e.g., faucets 26, 28. Cold water also flows on demand, through pipe 30, to, e.g., faucets 32, 34, and via pipe 36 to standard fill valve assembly 38 in toilet flush tank 40.

As the water 23 in heater 22 is heated, it expands within the piping system. If the system is closed, the pressure increases, potentially to dangerous levels. To avoid damage to components of the system, a primary temperature-and-pressure relief valve 42 is typically provided on the water heater 22. Valve 42 is preset to release at pressures above the normal system pressure, but below the pressure at which damage to the system components is likely to occur, e.g., 150 pounds per square inch is typical. It has been found, however, that repeated discharge of relief valves at this location, i.e., in the hot water line, are susceptible to buildup of solids and liming which adversely affect the performance and life span of the valve.

In order to provide a more reliable relief valve arrangement, without requiring the expense of an expansion tank or additional piping or inconvenience of an open secondary relief valve, as described in the introduction above, the thermal expansion pressure relief arrangement shown in FIG. 1, and in more detail in FIG. 2, employs a toilet fill valve assembly 38 equipped with a pressure relief valve 44.

Referring to FIG. 2, standard toilet fill valve assembly 38 consists of a fill valve body 50 with water inlet chamber 52 with system water pressure entering at the inlet base 54 from inlet tube 36. A standard pressure relief valve, set at a predetermined pressure, e.g., 25 pounds per square inch below the setting of the primary temperature-and-pressure relief valve 42 at the heater 22, e.g., at about 125 pounds per square inch, extends from the fill valve assembly body at a position above the water level 56 and allows an air gap within the toilet flush tank above the overflow tube 84.

Relief valve 44 consists of a valve body 60, which is integrally formed with fill valve assembly body 50, e.g., by molding, a sealing disk 62, e.g., silicone or the like, a disk holder 64, an adjusting spring 66 and adjusting screw 68. The inner bore of the relief valve body 60 is internally threaded to permit adjustment of the relief pressure setting by rotation of adjustment screw 68 which is also threaded. Drain port 70 is provided to allow water passing seal 62 to drain from the relief valve body into the flush tank, and vent holes 88 are defined through the valve body about its circumference to prevent siphoning.

The toilet flush tank components are also standard, further including fill valve 38, float 74, float arm 76, tank ball 78 at the end of chain 80 from flush arm 82, standing overflow tube 84, refill tube 86 and bracket guide 89. The top of the fill valve assembly is also apertured (90) to provide automatic means for breaking siphon to prevent backflow from the flush tank into the household water supply system.

As hot water 23 is drawn from heater 22, e.g., by opening faucets 26, 28, colder water replaces the hot water in the heater. The colder water is then heated toward the preset temperature, the water expanding in volume as its temperature is increased. If the faucets are open, potentially damaging expansion or pressure increase does not take place. After the faucets are closed, however, expansion of the water being heated causes the pressure in the now closed system to increase. (In a typical home system, heating the water in the heater from supply temperature to preset heater temperature (60° F. to 140° F.) causes an increase of the volume of water contained in the system of the order of about $1\frac{1}{2}$%)

If no secondary pressure relief means is provided, this expansion will cause activation of the primary temperature-and-pressure relief valve 42 on an intermittent basis or, if no primary valve exists, it will cause damage to some other component of the system, e.g., rupture of the water heater.

In the pressure relief arrangement of the invention, protection is provided by means of pressure relief valve 44 disposed in the toilet flush tank. As pressure in the system increases to the preset pressure limit of valve 44, seal 62 is unseated, allowing water flow into the body 60 of the valve and out drain port 70 into the toilet flush tank, thus automatically relieving the pressure in the system. If a significant amount of water is discharged via the relief valve, e.g., a 30-gallon water heater operating to increase water temperature from 60° F. to 140° F. will cause an increase in volume of about 0.4 gallons, causing the level 56 to rise, any excess merely flows into overflow tube 84, which serves to keep the water at a desired level without danger of overflow.

Other embodiments are within the following claims, for example, the pressure relief valve of the invention may be constructed separately and attached to the fill valve assembly body, e.g., by drilling and tapping the fill valve body to receive a threaded relief valve body. Also, the relief valve may be constructed to deliver any overflow directly into the overflow tube 84 if desired.

What is claimed is:

1. In a water piping arrangement connected to a main water supply conduit, said arrangement comprising a system of pipes adapted to conduct water, and disposed in said system of water-conducting pipes, a backflow preventer valve adapted to permit flow of water from said main water supply conduit into said arrangement and to prevent flow of water in the reverse direction, a water heater, a primary relief valve disposed in a hot water line associated with said heater or on the heater and adapted to activate at a predetermined activation pressure selected to be below the pressure at which said arrangement would be damaged to relieve pressure in said system, and a toilet flush tank, including a fill valve assembly and overflow drain therein, the improvement wherein said fill valve assembly further comprises pressure relief valve means in communication with said supply pipe and located in said tank and adapted to activate at a predetermined pressure below the activation pressure of said primary relief valve to release a volume of waste water from said system of pipes into said toilet flush tank fr draining therefrom through said overflow drain to maintain water pressure in said system below a predetermined maximum, thereby locating said pressure relief means in and discharging said volume of waste water into the confined enclosure of said toilet flush tank.

2. The water piping arrangement of claim 1 wherein said secondary relief valve means is constructed in a manner to cause water released from said system to flow directly into an overflow tube in said toilet flush tank.

3. The water piping arrangement of claim 1 wherein said secondary relief valve means and said fill valve assembly are integrally joined.

4. A method of providing secondary relief from buildup of water pressure in a system of piping due to thermal expansion of water in said system, said system including a toilet fill valve assembly including a supply pipe connected to said system and a valve within a toilet flush tank and an overflow drain therein, said method comprising:

installing backflow prevention means in said system, thereby preventing flow of water in said system to a main water supply conduit, installing, in communication with a supply pipe of said toilet fill valve assembly of said toilet flush tank, secondary pressure relief valve means adapted at a predetermined pressure below a pressure of activation of a primary relief valve, to activate to release a volume of waste water from said system of piping into said toilet flush tank for draining therefrom through said overflow drain, thereby maintaining the pressure in said system below a predetermined maximum and locating said pressure relief means in and discharging said volume of waste water into the confined enclosure of said toilet flush tank.

5. The method of claim 4 wherein said secondary pressure relief valve means is integrally formed with a fill valve assembly and said method comprises installing the secondary pressure relief valve and fill valve assembly as a unit.

6. In a fill valve assembly adapted for use in a toilet flush tank having an overflow drain therein, said assembly comprising a body defining a chamber for water from a water inlet pipe, means for mounting said body in said tank, a fill valve in communication with said water inlet pipe, and a float means for actuating said fill valve for flow of water from said inlet pipe therethrough into said tank, the improvement wherein said fill valve assembly further comprises a pressure relief valve disposed in communication, through said body, with said water inlet pipe, said pressure relief valve comprising a body and pressure relief means adapted to activate at a predetermined pressure to allow flow of water therethrough into said toilet flush tank, thereby permitting locating said pressure relief means in and discharging said volume of wastewater into the confined enclosure of said toilet flush tank.

7. The fill valve assembly of claim 6 wherein the body of said fill valve assembly and the body of said relief valve means are integrally formed.

8. The fill valve assembly of claim 7 wherein the body of said fill valve assembly and the body of said relief valve means are an integral molded unit.

* * * * *